United States Patent [19]

Jensen et al.

[11] 4,060,936

[45] Dec. 6, 1977

[54] CONTAINER AND DOOR

[75] Inventors: Richard H. Jensen, Torrance; Peter P. Parris, Tustin, both of Calif.

[73] Assignee: Brooks & Perkins, Incorporated, Southfield, Mich.

[21] Appl. No.: 703,616

[22] Filed: July 8, 1976

[51] Int. Cl.[2] ..... E05C 21/02

[52] U.S. Cl. ..... 49/465; 220/1.5

[58] Field of Search ..... 49/465, 463, 466; 220/1.5, 323; 292/142, 39, 160, 172

[56] References Cited

U.S. PATENT DOCUMENTS

| | | | |
|---|---|---|---|
| 3,485,406 | 12/1969 | Borden | 220/1.5 |
| 3,521,920 | 7/1970 | Morand | 292/39 R |
| 3,904,064 | 9/1975 | Looker | 220/1.5 |
| 3,915,327 | 10/1975 | Lovich et al. | 220/1.5 |
| 3,926,243 | 12/1975 | Lovich et al. | 220/1.5 |

*Primary Examiner*—Philip C. Kannan
*Attorney, Agent, or Firm*—Whittemore, Hulbert & Belknap

[57] ABSTRACT

A cargo container is provided with a door opening having means for engaging and disengaging the top and/or bottom of the door on vertical movement thereof. A hollow rail extends across the top and/or bottom of the door opening and has elongated slots therein provided with slot-enlargements for receiving a foot or feet of a locking member movable along the bottom and/or top of the door. The locking member includes a reduced portion movable through the slot and an enlarged portion having a transverse dimension greater than the width of the slot. Suitable means, preferably rack and pinion means, are provided for shifting the locking members along the door to locking position after movement through the slot-enlargements into the interior of the rail.

17 Claims, 8 Drawing Figures

CONTAINER AND DOOR

BRIEF SUMMARY OF THE INVENTION

The present invention is concerned primarily with the containers adapted to be loaded with luggage or cargo and thereafter moved into the interior of a transport vehicle such, for example, as an aircraft.

Preferably, the container is shaped generally to conform to the space available within the aircraft and includes at least one open side to facilitate loading and unloading the container. The open side is adapted to be closed by one or more removable side doors which when installed leave a central generally rectangular door opening. A rectangular door for closing this opening is provided and is completely removable from the opening. The door is provided with edge constructions engaging the side doors so that when the central door is locked in position, it prevents removal of the side doors.

The means for supporting the central door, which will hereafter usually be referred to as "the door, " comprises releasable means for engaging the top edge of the door, which means is operable only upon vertical movement of the door. For example, the container may have a downwardly open channel extending across the door opening at the top into which the top edge of the door may be inserted sufficiently to permit its bottom edge to clear a bottom rail provided at the bottom of the door opening. Thereafter, the door may be lowered sufficiently to engage lock means at the bottom of the door while retaining the upper edge of the door in the channel. Alternatively, the upper edge of the door may be engaged by suitable hook means provided at the top edge of the door and at the top edge of the door opening.

The present invention is concerned primarily with the locking structure provided at the bottom of the door opening and door. For this purpose the door opening includes a bottom rail having a hollow interior, the upper wall of which is provided with an elongated relatively narrow slot. At one or more zones along this slot the slot is enlarged to provide a slot-enlargement through which a locking member may be moved. The locking member includes a reduced portion dimensioned to be movable along the slot and a lower laterally enlarged portion adapted to move through the slot-enlargement but engageable with the undersides of the top wall of the rail adjacent the slot when the locking member is moved along the bottom edge of the door out of registration with the slot-enlargement.

Preferably, two slot-enlargements and two locking members are provided and common means are provided for effecting movement of the locking members. In the preferred embodiment of the invention the common means for moving the locking members comprises a pair of racks having opposed teeth and a pinion interposed between the racks and in mesh therewith. Rotation of the pinion by an operating lever effects simultaneous movement of the locking members in opposite direction.

A stop is provided in position to be adjacent an operating handle when the locking members are in locking position and the stop and handle may be locked together by suitable means such for example as a padlock to prevent unauthorized entry or removal of the door.

DETAILED DESCRIPTION

Figure 1:
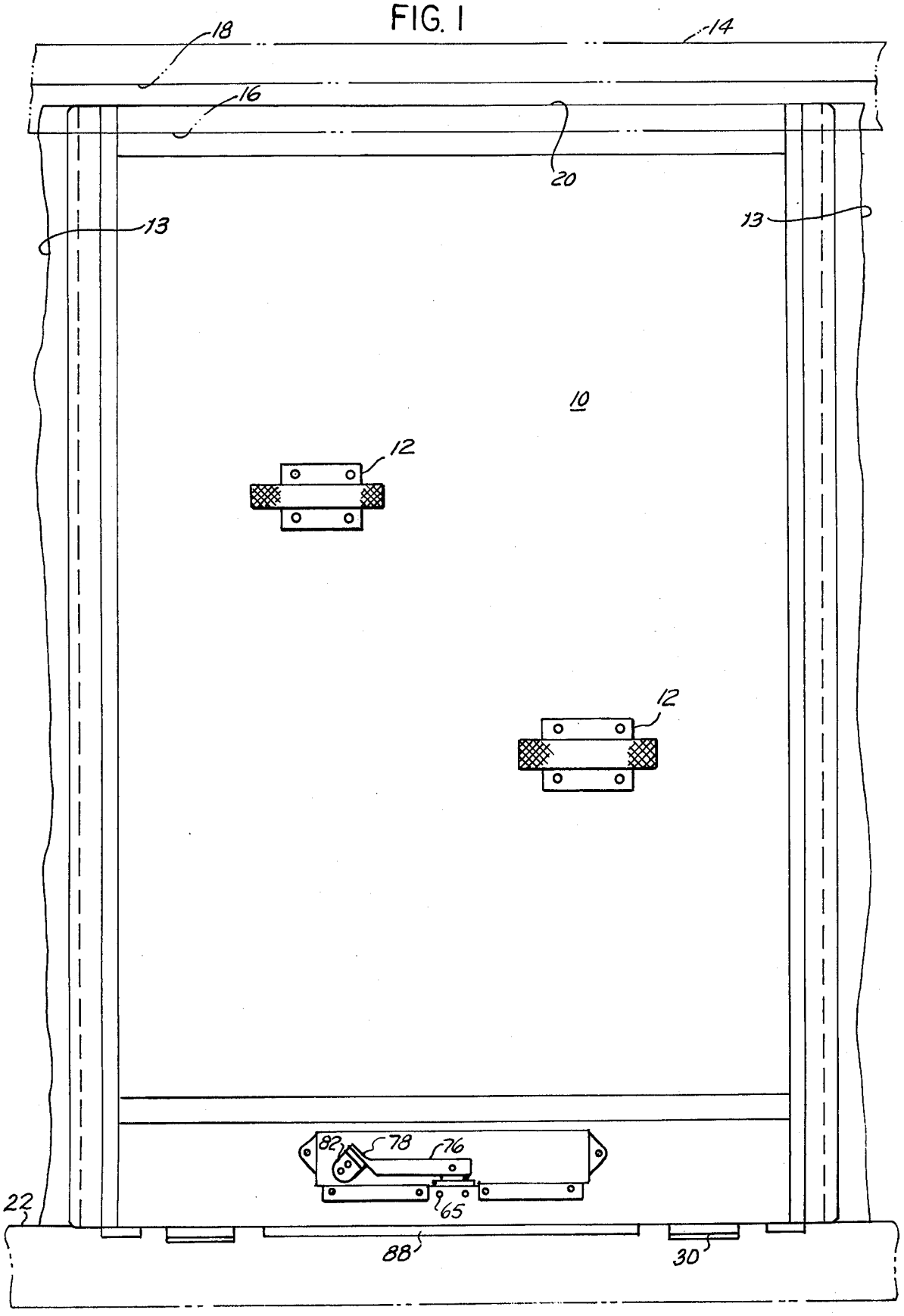
FIG. 1 is a front elevation of the door illustrating its relationship to top and bottom rails defining the top and bottom edges of the door opening.
Figure 2:
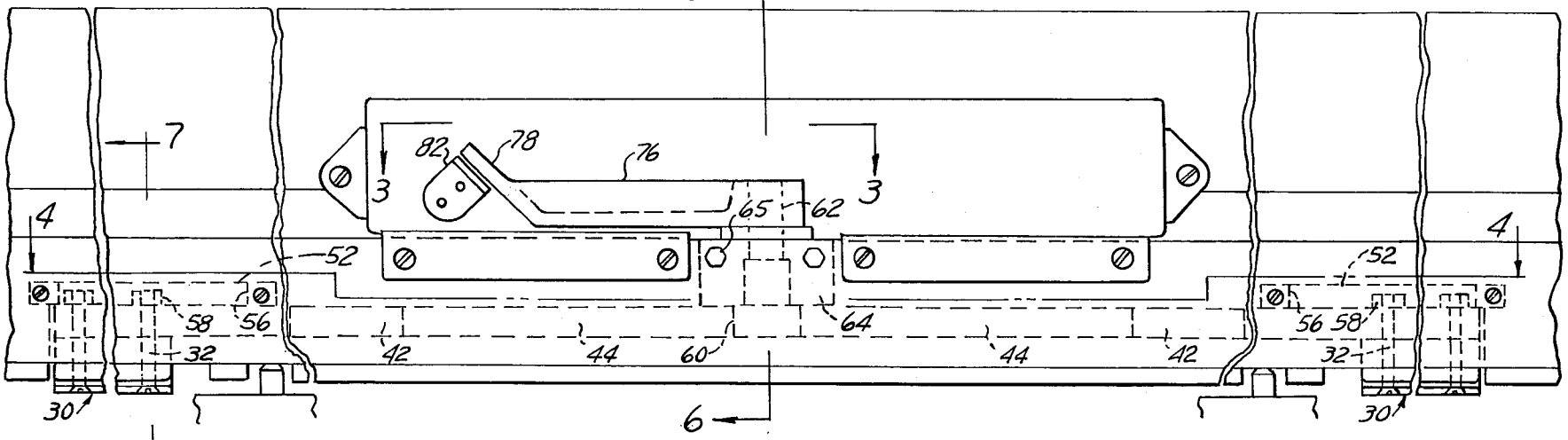
FIG. 2 is a front elevational view taken at the bottom of the door.

Referring first to FIG. 1 the door is indicated generally at 10 and is provided with hand holding devices 12 by means of which the door can be moved into and out of position between side doors, edge portions of which are shown at 13, to close the door opening. The general arrangement of side and intermediate doors is fully disclosed in prior U.S. Pat. No. 3,710,513, granted Jan. 16, 1973. The door opening is defined by an upper rail indicated in dot and dash lines at 14, and a bottom rail indicated diagrammatically in dot and dash lines at 22. The upper rail has two horizontally spaced downwardly extending flanges terminating at the dot and dash line 16 and the space between the flanges terminates at a transverse wall indicated in dot and dash lines at 18. From this Figure it will be observed that in the illustrated relationship, the top edge of the door indicated at 20, is spaced downwardly below the channel wall 18 so that the door when its bottom edge is released can be moved upwardly in the channel sufficiently to clear locking means provided along its bottom edge.

Instead of the illustrated arrangement it will be understood that the top edge of the door may be releasably engaged by suitable hook means. In either case, engagement and disengagement of the top edge of the door requires vertical movement of the door. At the bottom edge of the door there is provided a horizontal rail, shown diagrammatically in broken lines at 22 in FIG. 1 and illustrated in detail in FIG. 7.

In accordance with the present invention manual operable means are provided for locking the lower edge of the door to the rail 22 in such a way as to prevent vertical movement of the door. This in turn, as previously suggested, will prevent disengagement of the top edge of the door from the top rail and will insure that the door remains in closing position.

Figure 5:
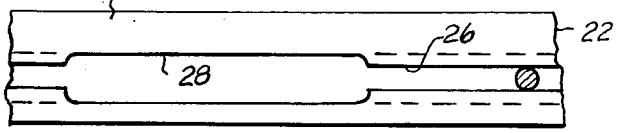
FIG. 5 is a fragmentary plan view of the bottom rail of the door opening.
Figure 3:
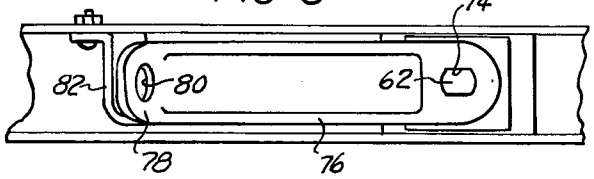
FIG. 3 is a fragmentary plan view looking in the direction of the arrows 3—3, FIG. 2.
Figure 7:
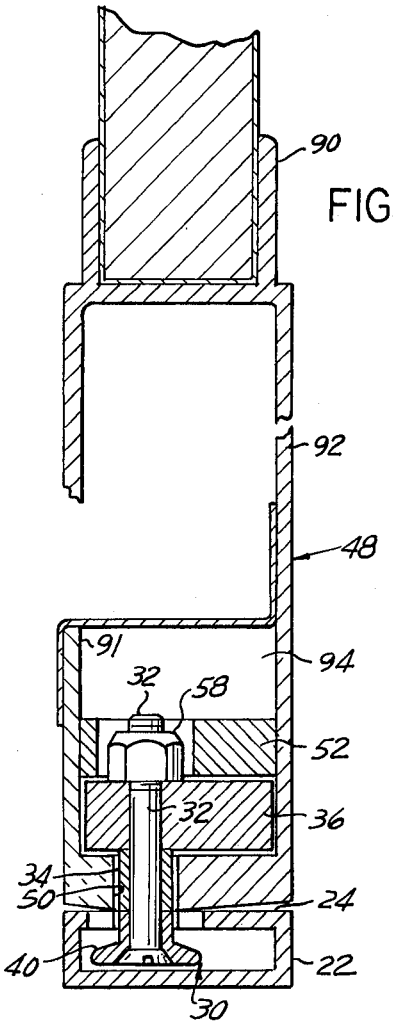
FIG. 7 is an enlarged sectional view on the line 7—7, FIG. 2.

Referring now to FIG. 5 there is shown a portion of the bottom rail 22 and as is apparent from this Figure and from FIG. 7, the rail has a hollow interior. The top wall 24 of the rail is provided with an elongated slot 26 provided with a pair of slot-enlargements 28 for receiving locking members 30.

Figure 8:
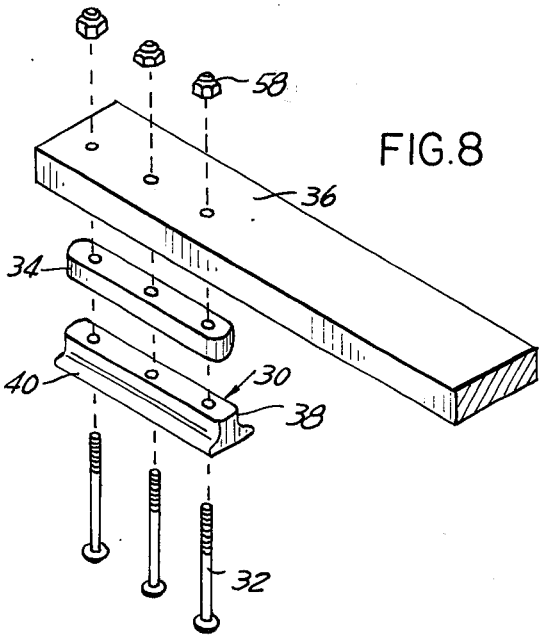
FIG. 8 is an exploded fragmentary view showing a detail of the construction.

Locking members 30 are secured by bolts 32 to a guide spacer 34 fastened to the underside of a slide 36, as best illustrated in the exploded view of FIG. 8.

Figure 4:
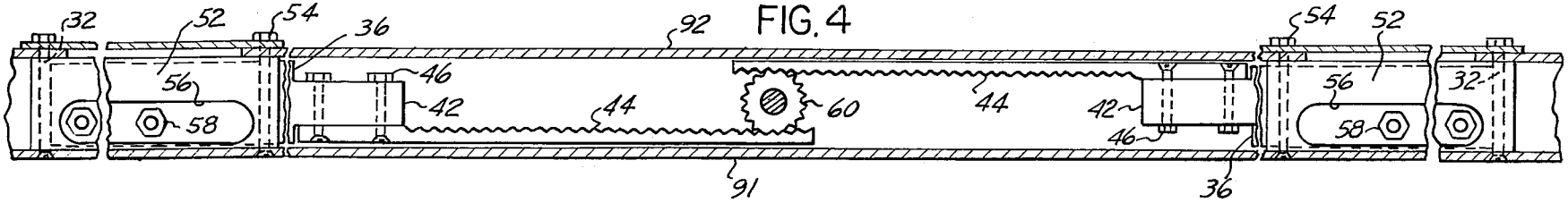
FIG. 4 is a fragmentary sectional view taken on the line 4—4, FIG. 2.
Figure 6:
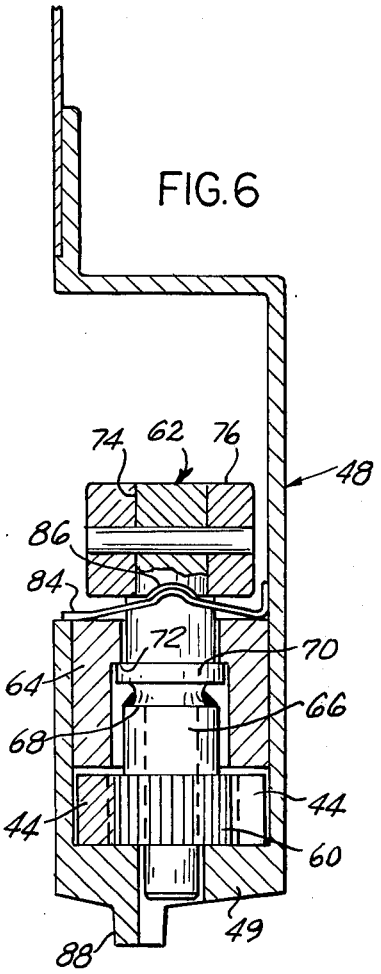
FIG. 6 is an enlarged sectional view on the line 6—6, FIG. 2.

It will be observed that the locking member 30 includes an elongated upper reduced portion 38 which is dimensioned to be movable longitudinally in the slot 26. The locking member includes laterally extending portions 40 dimensioned to pass through the slot-enlargements 28 but to underlie the portions of top wall 24 at the sides of the slot 26. Thus, when the locking member 30 is moved out of registration with the enlargement 28 it prevents vertical movement of the door. This not only locks the bottom of the door against outward movement, but also prevents disengagement between the upper edge of the door and the door frame. The slide 36 has a reduced portion 42 to which a rack 44 is secured by bolt means indicated generally at 46. It will be appreciated that, as seen in FIG. 4, slides are provided in spaced relation and a corresponding rack 44 is provided the teeth of which confront the teeth of the first rack 44, all as clearly evident in FIG. 4.

The slide 36 is movable in the bottom of a door frame bar 49 in the form of an extrusion having a bottom wall 49 provided with an elongated slot 50 in which the guide spacer 34 is movable. The slide 36 is retained against the bottom wall of the bottom door frame by a retainer plate or bar 52 which is bolted to the bottom rail 48 as indicated at 54. Retainer plate 52 is provided with an elongated opening 56 which accommodates the nuts 58 secured to the bolts 32 which assemble the slide 36, the guide spacer 34, and the locking member 30.

Intermediate the overlapped ends of the racks 44 is a pinion 60 secured to a shaft 62 for rotation therewith. The shaft 62 is retained in the channel provided at the bottom of the rail 48 by a pivot member 64 secured by bolts 65 to the walls of the channel. The pinion 60 includes a reduced axial extension 66 fixed to the underside of a flange 68 formed on the shaft 62. The shaft 62 is retained in the pivot 64 by a flange 70 engaged under a shoulder 72 provided on the pivot.

In order to rotate the shaft 62, to which the pinion 60 is fixed for rotation, the upper end of the shaft is flattened as indicated at 74 and receives a handle 76 having a laterally extending end portion 78 apertured as indicated at 80. Mounted on the front of the door is an apertured lug or stop 82, the aperture therein registering with the aperture 80 in the handle 76 when the handle is swung to the position which moves the locking means to locking position. The door may then be locked against unauthorized removal by a padlock or the like inserted through the registered openings.

A latch spring 84 is provided having a projection 86 adapted to be received in a corresponding recess provided at the underside of the portion of the handle surrounding the shaft 62.

Referring again to FIG. 1 it will be observed that the bottom of the door 10 is preferably provided with a depending flange 88 which is dimensioned to be received in the slot 26. The flange 88 assists in locating the door and prevents forward movement of the bottom edge of the door until the door has been elevated sufficiently to lift the flange 88 out of the slot as the locking members 30 are moved upwardly through the slot-enlargements.

As best seen in FIG. 7 the lower end of the door comprises the bar 48 in the form of an extrusion having laterally spaced upwardly extending flanges 90 between which the lower edge of the door proper is received. The bar 48 is provided with a short upwardly extending flange 91 and a rear wall 92 defining with the bottom wall 49 a channel 94 which receives the locking mechanism and actuator therefor.

As best seen in FIG. 7 the slide 36 is longitudinally movable in the channel 94 and is retained in position by the retainer bar 52 which is bolted to the channel walls 91, 92 by the fastening means 54.

It will be noted that the top edges of the door and frame may have the latch as described heretofore in connection with the bottom edges thereof.

What we claim as our invention is:

1. A container having a generally rectangular opening, a door movably bodily into and out of said opening, said container having at the top of the opening upper retainer means for releasably engaging the top edge of said door and a bottom rail extending across the opening at the bottom thereof, said rail having inwardly directed spaced flanges leaving an upwardly open elongated slot therebetween, the spacing between said flanges being increased for a limited distance to define a lock-receiving slot-enlargement, said door having means for engaging said upper retainer means to support the upper edge of said door against forward displacement except when the entire door is moved substantially vertically, the bottom edge of said door having a downwardly depending lock member shaped to move through said slot-enlargement but dimensioned to be engageable with the underside of said flanges adjacent said slot when said lock member is moved longitudinally of said rail out of registration with said slot-enlargement, and means for moving said lock member along the bottom edge of said door after insertion downwardly through said slot-enlargement to retain said door against vertical movement and hence against removal from said container opening.

2. A container as defined in claim 1 in which the means for moving said lock member comprises an elongated rack connected to said lock member and a rotary pinion in mesh with said rack and mounted on the front of said door.

3. A container as defined in claim 1 in which the slot in said rail has a pair of slot-enlargements, and said door is provided with a pair of lock members, and the means for moving said lock member is connected to both of said lock members and includes a single manual operator for simultaneously moving both of said lock members along the bottom edge of said door.

4. A container as defined in claim 3 in which the means for moving said lock members comprises a pair of elongated racks movable along the bottom edge of said door, each of said racks being connected to one of said lock members, a pinion intermediate said racks and in mesh with both of said racks and rotatably carried by said door to effect simultaneous movement of said lock members in opposite directions to move them into or out of registration with said slot-enlargements.

5. A container as defined in claim 4 comprising a manual operator connected to said pinion, a fixed stop on said door adjacent said operator when said lock members are out of registration with said enlargements, and means providing for securing said operator to said stop to lock said door against unauthorized removal.

6. A container as defined in claim 1 in which a pair of removable side doors are provided and said first mentioned door is positioned between and is dimensioned to close the space between said side doors.

7. A container as defined in claim 6 in which said door is engageable with both of said side doors and shaped to prevent removal of said side doors while said door is in closing position whereby locking said door also locks said side doors against removal.

8. A container having a generally rectangular opening, a door movable bodily into and out of said opening, said container having at the top of the opening upper retainer means for releasably engaging the top edge of said door and a bottom rail extending across the opening at the bottom thereof, said rail having inwardly directed spaced flanges leaving an upwardly open elongated slot therebetween, the spacing between said flanges being increased for a limited distance to define a lock-receiving slot-enlargement, said door having means for engaging said upper retainer means to support the upper edge of said door against forward displacement except when the entire door is moved substantially vertically, the bottom edge of said door comprising an elongated bottom frame bar having an upwardly open channel defined by a bottom wall, an upwardly extending flange, and a rear wall, the bottom wall of said channel having an elongated opening therethrough, a slide in said channel slidable on the bottom wall thereof, a retainer bar in said channel overlying said slide and secured to said flange and rear wall, a lock member secured to the underside of said slide and movable therewith along the bottom edge of said door, said lock member having a narrow portion movable in said slot and an enlarged lower portion movable through said slot-enlargement and having a width greater than the width of said slot.

9. A container as defined in claim 8 comprising an elongated guide spacer received in the elongated opening in the bottom wall of said bottom frame bar and longitudinally slidable therein, said guide spacer being interposed between said slide and lock member.

10. A container as defined in claim 9 in which said lock member, guide spacer and retainer bar are secured together by fastening members extending above said slide, said retainer bar having an elongated opening in which the upper ends of said fastening members are movable.

11. A container having a generally rectangular opening, a door movable bodily into and out of said opening, said container having at the top of the opening upper retainer means for releasably engaging the top edge of said door and a bottom rail extending across the opening at the bottom thereof, said rail having inwardly directed spaced flanges leaving an upwardly open elongated slot therebetween, the spacing between said flanges being increased for a limited distance to define a lock-receiving slot-enlargement, said door having means for engaging said upper retainer means to support the upper edge of said door against forward displacement except when the entire door is moved substantially vertically, the bottom edge of said door comprising an elongated bottom frame having an upwardly open channel defined by a bottom wall, an upwardly extending flange, and a rear wall, the bottom wall of said channel having an elongated opening therethrough, a slide in said channel, a rack connected to said slide, a pinion in said channel, a shaft fixed to said pinion, a pivot mount for said shaft fixed in said channel, and an operating handle secured to said shaft.

12. A container as defined in claim 11 in which said pivot mount has a downwardly facing annular shoulder, and said shaft has an upwardly facing annular surface engageable therewith to retain said shaft against longitudinal displacement while providing for rotation thereof.

13. A door capable of bodily insertion into and removal from a door frame having a bottom rail provided with a longitudinally extending slot having a lock receiving slot-enlargement therein, said door comprising an elongated bottom frame bar having an upwardly open channel defined by a bottom wall, an upwardly extending flange, and a rear wall, the bottom wall of said channel having an elongated opening therethrough, a slide in said channel slidable on the bottom wall thereof, a retainer bar in said channel overlying said slide and secured to said flange and rear wall, a lock member secured to the underside of said slide and movable therewith along the bottom edge of said door, said lock member having a narrow portion movable in the slot and an enlarged lower portion movable through the slot-enlargement and having a width greater than the width of the slot.

14. A door as defined in claim 13 comprising an elongated guide spacer received in the elongated opening in the bottom wall of said bottom frame bar and longitudinally slidable therein, said guide spacer being interposed between said slide and lock member.

15. A door as defined in claim 14 in which said lock member, guide spacer and retainer bar are secured together by fastening members extending above said slide, and retainer bar having an elongated opening in which the upper ends of said fastening members are movable.

16. A door capable of bodily insertion into and removal from a door frame having a bottom rail provided with a longitudinally extending slot having a lock receiving slot-enlargement therein, said door comprising an elongated bottom frame bar having an upwardly open channel defined by a bottom wall, an upwardly extending flange, and a rear wall, the bottom wall of said channel having an elongated opening therethrough, a slide in said channel slidable on the bottom wall thereof, a retainer bar in said channel overlying said slide and secured to said flange and rear wall, a lock member secured to the underside of said slide and movable therewith along the bottom edge of said door, said lock member having a narrow portion movable in said slot and an enlarged lower portion movable through said slot-enlargement and having a width greater than the width of said slot, a rack connected to said slide, a pinion in said channel, a shaft fixed to said pinion, a pivot mount for said shaft fixed in said channel, and an operating handle secured to said shaft.

17. A door as defined in claim 16 in which said pivot mount has a downwardly facing annular shoulder, and said shaft has an upwardly facing annular surface engageable therewith to retain said shaft against longitudinal displacement while providing for rotation thereof.

* * * * *